US005782272A

United States Patent [19]

Dewispelaere

[11] Patent Number: 5,782,272

[45] Date of Patent: Jul. 21, 1998

[54] PIEZOELECTRIC SHED SELECTING DEVICE

[75] Inventor: André J. Dewispelaere, Marke, Belgium

[73] Assignee: N.V. Michel van de Wiele, Marke, Belgium

[21] Appl. No.: 717,868

[22] Filed: Sep. 23, 1996

[30] Foreign Application Priority Data

Oct. 27, 1995 [BE] Belgium ..... 09500885

[51] Int. Cl.[6] ..... D03C 3/20

[52] U.S. Cl. ..... 139/455; 66/220

[58] Field of Search ..... 139/455; 66/220, 66/218

[56] References Cited

U.S. PATENT DOCUMENTS

| | | | |
|---|---|---|---|
| 4,969,490 | 11/1990 | Seiler | 139/455 |
| 5,309,952 | 5/1994 | Speich | 139/455 |
| 5,333,652 | 8/1994 | Bassi et al. | 139/455 |
| 5,373,871 | 12/1994 | Speich | 139/455 |
| 5,392,820 | 2/1995 | Seiler | 139/455 |

FOREIGN PATENT DOCUMENTS

| | | |
|---|---|---|
| 348338 | 12/1989 | European Pat. Off. . |
| 4309983 | 3/1994 | Germany . |
| 2273719 | 6/1994 | United Kingdom . |
| WO9216679 | 10/1992 | WIPO . |
| WO9325744 | 12/1993 | WIPO . |

OTHER PUBLICATIONS

Patent Abstracts of Japan, vol. 014, No. 149, Mar. 22, 1996 & JP-A-02 019534 (Takemura Seisakusho:KK), Jan. 23, 1990.

*Primary Examiner*—Andy Falik

*Attorney, Agent, or Firm*—Sughrue, Mion, Zinn, Macpeak & Seas, PLLC

[57] ABSTRACT

A shed forming device for selecting a shed forming apparatus with the assistance of piezoelectric bending elements in a weaving and/or knitting machine of the jacquard type intended for weaving and knitting patterns. The shed forming device includes complementary ascending and descending hooks and complementary ascending and descending blades adapted to cooperate and mutually hook and unhook. Each of the piezoelectric bending elements has a U-shaped clip at a free extremity thereof having one arm (17) that is adapted to slide over a corresponding one of the hooks. Each of the complementary hooks is attached to an elastic bending spring part which can slide up and down along a groove under the action of one of the ascending blades in order to raise a tackle and also a harness cord.

5 Claims, 3 Drawing Sheets

PIEZOELECTRIC SHED SELECTING DEVICE

BACKGROUND OF THE INVENTION

1. Field of the Invention

This invention relates to a shed forming device for selecting shed forming means with the assistance of piezoelectric elements, in a weaving and/or knitting machine of the Jacquard type, intended for weaving and knitting patterns.

2. Description of the Prior Art

A device for selecting hooks by means of piezoelectric bending elements for jacquard systems, has already been described in BE no. 9400595 and BE no. 9400855. The complementary ascending and descending hooks rest on complementary blades, which are moved up and down in opposition. The selection of a hook can only occur when this is in its upper position. This occurs by hooking onto a projection under action of an electromagnetic force or under the effect of a piezoelectric element. The selected hook remains suspended above and when the other complementary hook is raised the attached tackle and therefore the harness rope is also raised.

With jacquard machines, operating according to the unhooking principle, the hooks rest on a bottom grid or plank. The complementary blades move up and down in opposition and have a notch underneath where the hook can hook onto the blade. The selection of a hook occurs in the lower position of the hook. Through action of an electromagnetic force on the hook this is bent away and unhooked from its blade. With the upward movement of the blade the hook is then not engaged. It remains below and is therefore not selected for raising. If no external force acts on the hook, this will through effect of its own resilience hook into the blade and be engaged with upward movement: the hook is selected for raising.

A shed forming device for a textile machine, operating according to the unhooking principle, has already been described by WO 92/16678 and WO 92/16679.

Both documents propose using electromagnetic coils for selecting complementary hooks that are connected to each other by a rope and a tackle and because of this can only move in opposite directions. The shed forming device also comprises two blades that move in opposition to each other.

Electromagnetic coils use more electric power than piezoelectric elements. This electric power is partly transformed into heat through which the selection apparatus heat up and thus influence the room temperature in the workshop of the weaving mill.

SUMMARY OF THE INVENTION

The object of the invention is to provide a device whereby the selection for raising or not raising of a hook with jacquard systems, operating according to the unhooking principle, is carried out with piezoelectric bending elements. These piezoelectric elements operate very quickly, use little energy and develop no heat. The elements can however not develop any appreciable forces.

According to the invention the task is realized by means of a shed forming device comprising a piezoelectric bending element that has a U-shaped clip on the free extremity with a short arm that slides over the hook and a long arm that slides into a guiding groove of the frame.

The shed forming device is further characterized in that the complementary hooks are each attached to an elastic bending spring part, which can slide up and down along a groove under the action of an ascending blade in order to raise the tackle and therefore also the harness rope.

According to a distinctive feature of the invention the pliable hook is provided with a cam on the inside.

The complementary hooks rest with their tip on a bottom grid of the frame.

In straight position of rest of the piezoelectric bending element the clip is out of reach of the hook. When the blade reaches the lower return point, the blade presses on the cam so that the hook will deviate sideways. In this deviated position the clip can be slid over the hook without resistance, so that this cannot spring back and will remain unhooked. A second possibility is not to slide the clip over the hook. The hook can then spring back and hook into the blade.

In a first embodiment this clip can slide sideways and transverse to the direction of movement over the top of the hook by causing a piezoelectric element to bend by applying an electric voltage. When the electric voltage is switched off the piezoelectric bending element will return to its straight position and the clip slides back away from the hook.

In a second embodiment the clip will undergo translation in the direction of movement of the hook. This translation is achieved by means of for example a magnetostrictive material that by means of electric voltage works like a linear actuator. This linear actuator can be made double or single. With single design an actuator acts on both complementary hooks.

These characteristics and other characteristics and details of the invention will appear from the following description, with reference to the attached drawings, which by way of example and in no restrictive sense represent an embodiment of the invention.

BRIEF DESCRIPTION OF THE DRAWINGS

In these drawings.

In these drawings the same reference symbols indicate identical or similar elements.

DESCRIPTION OF PREFERRED EMBODIMENTS

Figure 1:
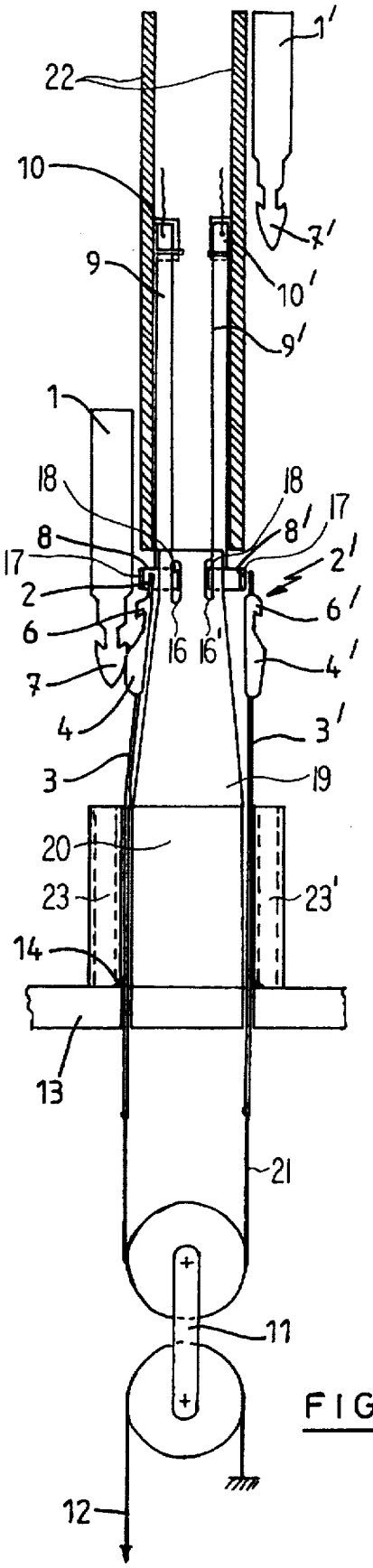
FIG. 1: is a front view of a shed forming device with two piezoelectric bending elements per harness rope.
Figure 2:
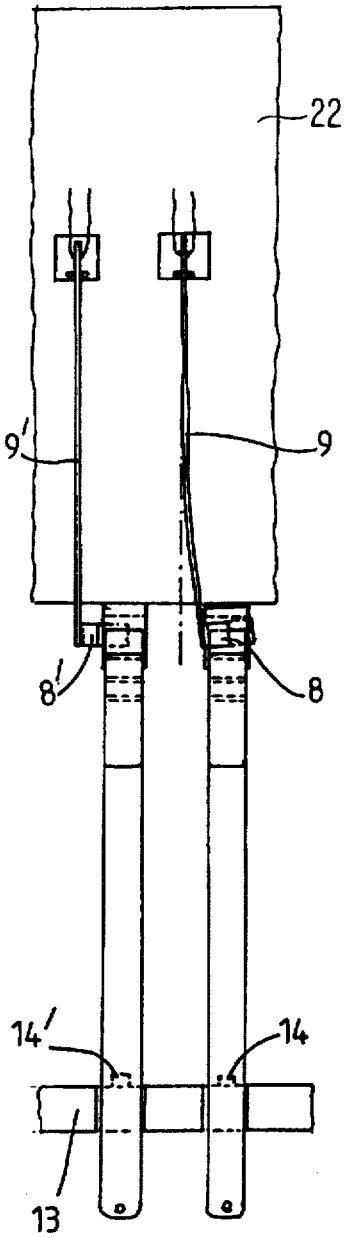
FIG. 2: is a side view of the device represented in FIG. 1.

As represented in FIG. 1, a shed forming device for selecting shed forming means in a weaving and/or knitting machine of the Jacquard type suitable for weaving or knitting patterns, comprises two complementary ascending and descending hooks 2, 2' that are connected to each other by one and the same rope 21. The complementary hooks 2, 2' can be engaged by complementary blades 1, 1' up and down along a vertical frame 19 divided into a wider rectangular support 20 and a smaller upper part 22. In FIG. 2, only the upper part 22 is shown, in order better to illustrate functioning of the spring parts 3, 3' and the clips 8, 8'. Known members 23, 23' are connected to frame 19 and bottom grid 13, and are guiding members for the hooks 2, 2'.

The piezoelectric bending elements 9 and 9' are clipped on one side into holders 10 and 10' with provisions for supplying an electric voltage. A clip 8 and 8' is attached to the other extremity of the piezoelectric bending element. The clip 8, 8' is U-shaped land has a long (18) and a short (17) arm. The short arm will slide over the hook and the long arm will slide in a guiding groove 16, 16' of the frame 19.

The two complementary blades 1 and 1' move up and down in opposition. A hook 2 will therefore be engaged or otherwise by blade 1 and the complementary hook 2' will be engaged or otherwise by blade 1'. The complementary hooks 2, 6 and 2', 6' rest with tips 14, 14' on a bottom grid 13. The hooks 2, 6 and 2', 6' have an elastic bending spring part 3, 3'. In straight position of the piezo bending element 9, 9' the clip 8, 8' is next to the movement path of the hook 2, 2'. When blade 1 reaches the lower return point, point 7 of blade 1 presses on a cam 4 of the hook 2. Hook 2 will be bent sideways. In this position a voltage is now applied to the piezoelectric bending element through which this will bend toward the hook. Because of this the clip 8 is slid over the hook 2. With the ascending movement of the blade 1 hook 2 is stopped by the clip 8 and hook 6 will not be able to hook into the blade. The hook 2 remains below resting on the bottom plank 13. If however no electric voltage is applied to the piezoelectric bending element 9, then the clip will not slide over hook 2 and with the ascending movement of blade 1 the hook 2 with springing out part 6 will hook into the blade 1 under action of bending spring 3. The hook 2 will therefore be engaged by the ascending blade 1. The tackle 11 is raised and therefore also the harness rope or cord 12. Harness rope 12 is further connected to a heddle that serves for raising the warp threads. This is not shown in the drawing.

On a following pick, blade 1' is below while blade 1 is above. The same method, as described above, can now be applied on the complementary hook 2' and the piezoelectric bending element 9'.

When blade 1 is below, blade 1' is above and the hook 2' can therefore either have remained below, or have been taken along upward. When blade 1' is below, then hook 2 can either have remained below, or have been taken along upward. The two positions can therefore be achieved or maintained on every pick.

In order to block the hook 2, 2' in its bent position, the clip 8 is made in a U or clamp shape. The shorter arm comes to lie in front of the hook when the piezoelectric bending element bends. The longer arm of the U-clip is guided into a slot in the frame. If blade 1 moves upward and the piezoelectric bending element 9 is bent through applying an electric voltage, then clip 8 will have been slid in front of the hook. At a certain time the hook 2, 2' with protruding part 6 will press against the shorter arm of the U-clip, through action of the bending spring 3. The clip 8 will then, because of the longer arm of clip 8 in the slot, prevent the hook from completely springing back toward the blade. If blade 1 is already sufficiently bent upward, the electric voltage of piezoelectric bending element 9 can be switched off. Now the bending element 9 should spring straight, but the pressure of the hook 2 on clip 8 causes friction through which the bending element 9 is prevented from spring back straight and hence is temporarily jammed. When however blade 1 descends again, blade point 7 will again press on cam 4 of the hook 2 and the piezo bending element 9 will immediately spring back straight if no electric voltage is applied. In order that the left clip 8 and right clip 8' would not affect each other, two bending elements are provided, i.e. one for each complementary hook. It is indeed very possible that the pressure force of for example hook 2 is sufficiently great to jam clip 8, through which the springing back of the bending element to straight position becomes impossible. The clip 8' would then come to lie with the short arm of clip 8' along side hook 2'. Blade point 7' would then press hook 2' against clip 8 and damage would occur. In order to avoid this, two piezoelectric bending elements are provided.

Figure 3:
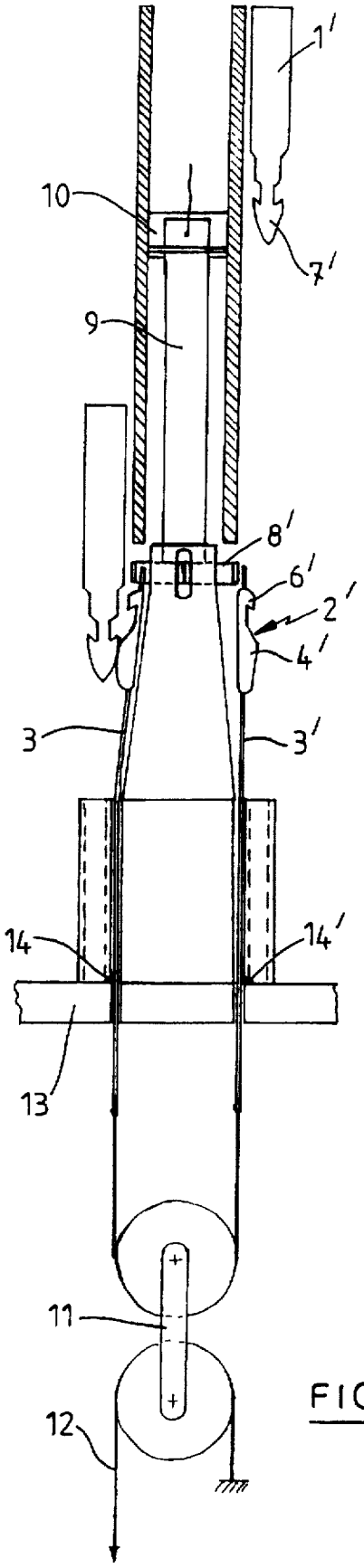
FIG. 3: is a front view of a shed forming device with only one piezoelectric bending element per harness rope.
Figure 4:
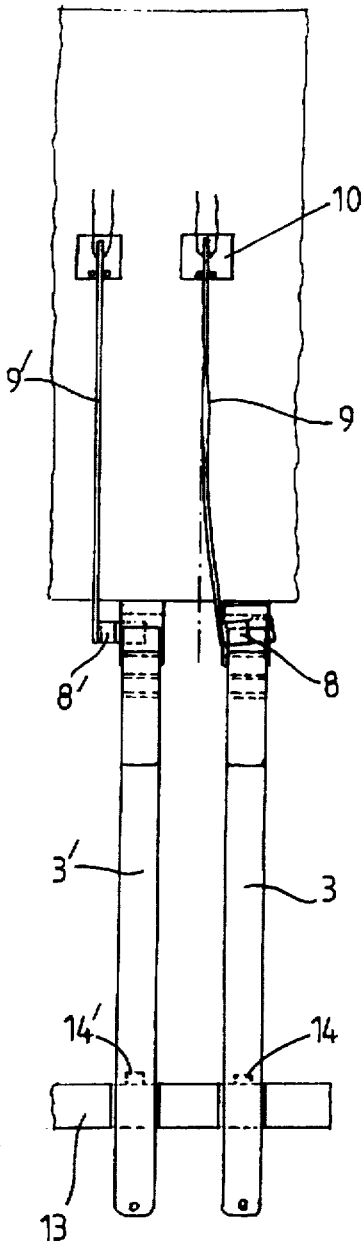
FIG. 4: is a side view of the device represented in FIG. 3.

Two complementary hooks can also be operated by one piezoelectric bending element to which one combined clip 8 is connected, as represented in FIG. 3 and 4. The condition is that the natural resetting force of the piezoelectric bending element is sufficiently great to overcome the friction force of the clip 8 in the slot caused by the resilience of the hook 2 or 2'. This is necessary in order to bring the clip 8 out of the way of the hook after each selection.

Figure 5:
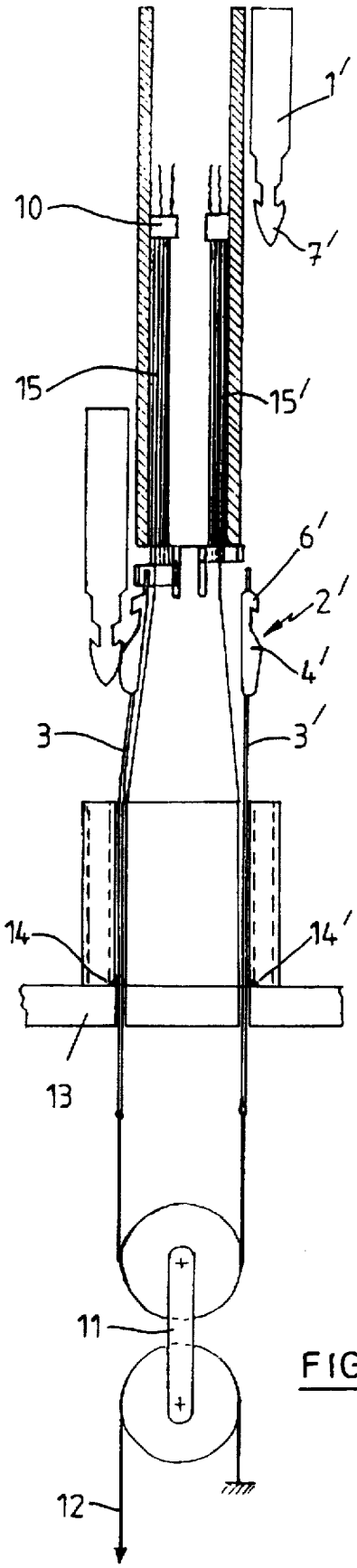
FIG. 5: is a front view of a shed forming device with two magnetostrictive linear actuators.
Figure 6:
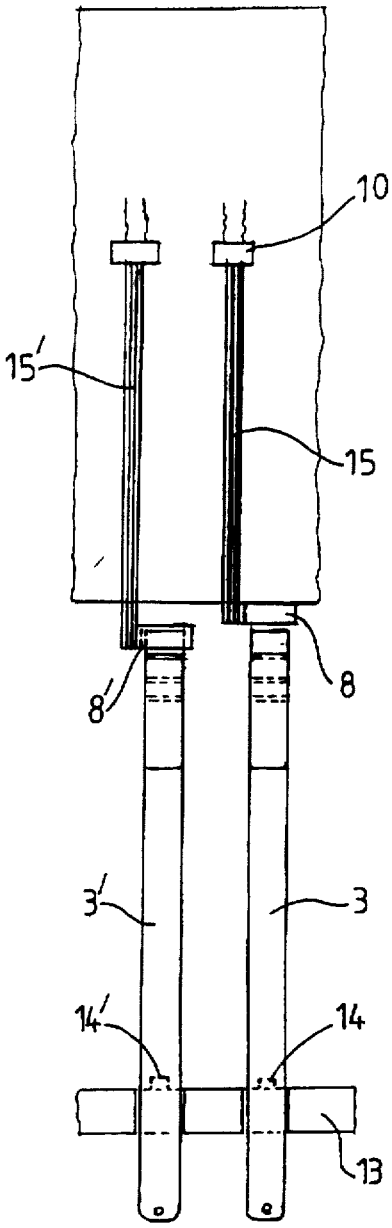
FIG. 6: is a side view of the device represented in FIG. 5.

In another embodiment FIG. 5 and 6 the clip 8, 8' undergoes a translation movement in the direction of movement of the hook through action of a linear actuator 15, 15', for example with a magnetostrictive material, that extends and/or contracts in one direction when switching an electric voltage on or off. With this actuator according to need the clip 8, 8' is slid over the hook 2, 2' in order to block this in its deviated direction. This embodiment can be provided with two actuators as drawn in FIG. 5 or one actuator, if the actuator is capable of overcoming the jamming force of the clip 8.

I claim:

1. A shed forming device including piezoelectric bending elements for selecting shed forming means with the assistance said piezoelectric bending elements, in a weaving and/or knitting machine of the Jacquard type, intended for weaving and knitting patterns, said shed forming device comprising complementary ascending and descending hooks (2, 2') and complementary ascending and descending blades (1, 1') adapted to cooperate and mutually hook and unhook, wherein each of the piezoelectric bending elements (9, 9') has a U-shaped clip at a free extremity thereof said clip (8, 8') having one arm (17) that is adapted to slide over a corresponding one of the hooks.

2. The shed forming device according to claim 1, wherein each of the complementary hooks (2, 2') is attached to an elastic bending spring part (3, 3'), which can slide up and down along a groove (21, 21') under the action of one of said ascending blades (1, 1') in order to raise a tackle (11) and therefore also a harness cord (12).

3. The shed forming device according to claim 1, wherein each hook (2, 2') is provided with a cam (4, 4') on the inside of the hook.

4. The shed forming device according to claim 1, wherein the clip (8, 8') has another longer arm (18) that is adapted to slide into a guiding groove (16) of a frame (19).

5. The shed forming device according to claim 2, wherein each hook (2, 2') is provided with a cam (4, 4') on the inside of the hook.

* * * * *